US005276601A

United States Patent [19]

Holzhacker

[11] Patent Number: 5,276,601

[45] **Date of Patent: * Jan. 4, 1994**

[54] LAMP SHADE HAVING AT LEAST TWO LATERALLY SPACED ARRAYS OF LIGHT DEFLECTORS

[76] Inventor: Albert Holzhacker, Rua Joao Felipe Silva 43, Sto. Amaro, Sao Paulo, Brazil, 04638

[ * ] Notice: The portion of the term of this patent subsequent to Nov. 24, 2009 has been disclaimed.

[21] Appl. No.: 966,851

[22] Filed: Oct. 27, 1992

Related U.S. Application Data

[63] Continuation-in-part of Ser. No. 789,955, Nov. 12, 1991, Pat. No. 5,165,787.

[51] Int. Cl.[5] ..... F21V 11/00

[52] U.S. Cl. ..... 362/354; 362/290; 362/325

[58] Field of Search ..... 362/351, 354, 360, 279, 362/282, 283, 290, 321, 322, 325

[56] References Cited

U.S. PATENT DOCUMENTS

| | | | |
|---|---|---|---|
| 77,115 | 4/1868 | Smith | 362/360 |
| 149,386 | 4/1874 | Fox . | |
| 188,700 | 3/1877 | Von Otter | 362/279 |
| 479,207 | 7/1892 | Edmond . | |
| 881,597 | 3/1908 | Lord . | |
| 1,518,012 | 12/1924 | Smith . | |
| 1,725,117 | 8/1928 | Walthers . | |
| 1,740,603 | 12/1929 | Kellert . | |
| 1,868,776 | 7/1932 | Tate . | |
| 2,437,825 | 3/1948 | Kohn | 362/354 |
| 2,670,431 | 2/1954 | Bullock | 362/354 |
| 2,997,576 | 8/1961 | Heitshu . | |
| 3,049,962 | 8/1962 | Denecke . | |
| 3,088,025 | 4/1963 | Deaton . | |
| 3,115,310 | 12/1963 | Hofman | 362/298 |
| 3,456,101 | 7/1969 | Rentschler . | |
| 3,774,024 | 11/1973 | Deaton . | |
| 4,314,320 | 2/1982 | Wolar . | |
| 4,499,529 | 2/1985 | Figueroa . | |
| 4,800,473 | 1/1989 | Tremblay . | |

*Primary Examiner*—Richard R. Cole

*Attorney, Agent, or Firm*—Cushman, Darby & Cushman

[57] ABSTRACT

A lamp shade including a plurality of light deflectors. The light deflectors are mounted so as to be independently moveable with respect to the frame and one another. Most preferably the lamp shade is defined by two or more spaced arrays of light deflectors. In one embodiment the light deflectors are mounted end to end to allow vertical variation in light intensity and direction. In another embodiment the light deflectors are both horizontally and vertically disposed to increase versatility in both appearance and lighting effect. Thus, the lamp shade advantageously allows the light to be directed in accordance with the particular area in which the light fixture is placed, both to shield the user's eyes and to direct light where it is most needed. At the same time, because the light emanating from the light source can be efficiently used in that it can be directed to the areas in which it is desired or required, in an amount determined by the user, a lesser wattage light source can be effectively used to light the area in the vicinity of the light source to the same extent as a higher wattage light source in a conventional shade.

22 Claims, 5 Drawing Sheets

LAMP SHADE HAVING AT LEAST TWO LATERALLY SPACED ARRAYS OF LIGHT DEFLECTORS

This application is a Continuation-In-Part of U.S. application No. 07/789,955, filed Nov. 12, 1991 now U.S. Pat. No. 5,165,787.

BACKGROUND OF THE INVENTION

1. Field of the Invention

The present invention relates to illumination devices and, in particular, to an adjustable lamp shade or shield formed from at least two laterally spaced arrays of light deflectors.

2. Description of the Related Art

Most lighting fixtures whether floor lamps, wall mounted light fixtures or ceiling fixtures, have diffusers or shades to prevent the light emitted from the light source from shining in the user's eyes, to direct the light towards the object or area to be lit, and/or for aesthetic purposes For example, floor and table lights typically have a shade which is semi-cylindrical or is conical to direct the light from the light source downwardly onto the surface of the desk or table, or towards a reading chair or the like.

A significant deficiency of conventional lamp shades and deflectors is that the intensity of light directed in a particular direction can not be altered, unless the entire shade is moved. For example, the light emitted from desk lamps is directed almost entirely downwardly. Accordingly, additional lamps and/or ceiling lights are typically required to fully illuminate a room. Likewise many wall mounted lamps have shades which direct substantially all of the light against or along the wall whereby the surrounding area will be only dimly lit. Thus, ceiling lights or a great number of fixtures must be provided for total lighting.

Further, because light emanating from a light source is typically confined to a particular area by lamp shades, a high light intensity is required if there is to be any peripheral lighting. Thus, a relatively high wattage light source is required for shaded lamps to achieve a given level of peripheral lighting.

Efforts have been made heretofore to produce devices for controlling the amount and direction of light emitted from a light source. For example, 3-way light bulbs and dimmer switches are commonly used to offer the user a variety of light intensities. Such devices, however, do not allow directional intensity variation.

Others have developed shades which allow the user to vary the amount of light allowed to pass therethrough. Typically, such shades are in the form of a plurality of louvers disposed either in a single plane in front of a spot or track light or in a cylinder surrounding the light source.

For example, U.S. Pat. No. 4,800,473 to Tremblay shows a lamp having a series of louvers that are lengthwise pivotable between an opened and a closed position. The louvers are simultaneously adjusted through the use of an annular gear mounted on the lamp base.

U.S. Pat. No. 2,437,825 to Kohn shows a lamp shade with a plurality of pivoting blades. The movement of a control ring causes rotation of the blades from an opened position to a closed position. Again, the blades are interconnected so that all blades are adjusted simultaneously.

U.S. Pat. No. 188,700 to Von Otter and U.S. Pat. No. 2,670,431 to Bullock also relate to lamp shades that have adjustable louvers that are simultaneously adjusted.

A problem common to each of the above-identified lamps is that the louvers cannot be independently adjusted to allow a higher degree of flexibility in directing the illuminating light.

Because the light deflectors of the above-noted structures can only be altered in unison, the resulting lighting effect is typically an all or nothing effect. The light is either allowed to pass through the shade or it is not and the user does not have the opportunity to adjust lighting in accordance with the particular environment in which the light fixture is used. Even if intensity passing through the shade can be gradually increased or decreased, only limited directional control is possible and, therefore, the light emitted can not be effectively utilized to maximize energy efficiency.

My earlier U.S. patent application No. 07/789,955, filed on Nov. 12, 1991, the disclosure of which incorporated herein by this reference, addressed these problems by providing a lamp shade wherein at least some of the light deflectors can be rotated independently of one another relative to the support frame. That is not to say, however, that improvement on my original concept is not possible, and, indeed, the invention disclosed herein constitutes an improvement thereof. More particularly, I found that with the light deflectors arranged in a single smoothly contoured array, light may pass through the inevitable crack between adjacent light deflectors thereby precluding a total blackout of light emanating through the lamp shade.

To address that potential concern, one may overlap the light deflectors of a single array. However, with the light deflectors arranged in this manner, it is no longer possible to completely independently rotate each light deflector with respect to the remaining light deflectors.

SUMMARY OF THE INVENTION

Thus, it is an object of the present invention to provide laterally spaced arrays of light deflectors which can selectively totally preclude the direct passage of light but which nevertheless permit independent movement of the light deflectors.

It is also an object of the present invention to provide a lamp that has adjustable light deflectors mounted so that the illuminating light may be directed in any manner desired.

It is a further object of the invention to reduce the required wattage of the light source, and thus the amount of energy required to light the room, by more efficiently directing the available light to those areas in which it is needed.

The foregoing and other objects of the invention are realized by providing a lamp shade including a) a first lamp shade portion including a first support frame; a plurality of light deflecting elements, each of the light deflecting elements having a first end and a second end spaced from the first end; and first mounting means for mounting at least one of the light deflecting elements to the first support frame so that said at least one of the light deflecting elements can be moved, independently, relative to the first support frame and other light deflecting elements; b) a second lamp shade portion including a second support frame; a plurality of light deflecting members, each of the light deflecting members having a first end and a second end spaced from the second end; and second mounting means for mounting at least one of the light deflecting members to the second support frame so that said at least one of the light deflecting members can be moved, independently, relative to the second support frame and other light deflecting members and c) the first lamp shade portion and the second lamp shade portion being interconnected but laterally spaced so that the light deflecting elements define a first array of light deflectors and the light deflecting members define a second array of light deflectors with a lateral gap being defined between the first and second arrays of light deflectors.

Thus, the present invention provides a light deflector system which advantageously allows the light to be directed in accordance with the particular area in which the light fixture is placed, both to shield the user's eyes and to direct light where it is most needed At the same time, because the light emanating from the light source can be efficiently used in that it can be directed to the areas in which it is desired or required in an amount determined by the user, a lesser wattage light source can be effectively used to light the area in the vicinity of the light source to the same extent as a higher wattage light source in a conventional shade. Thus, the inventive light deflecting system advantageously saves energy by most efficiently directing the light emanating from the light source.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
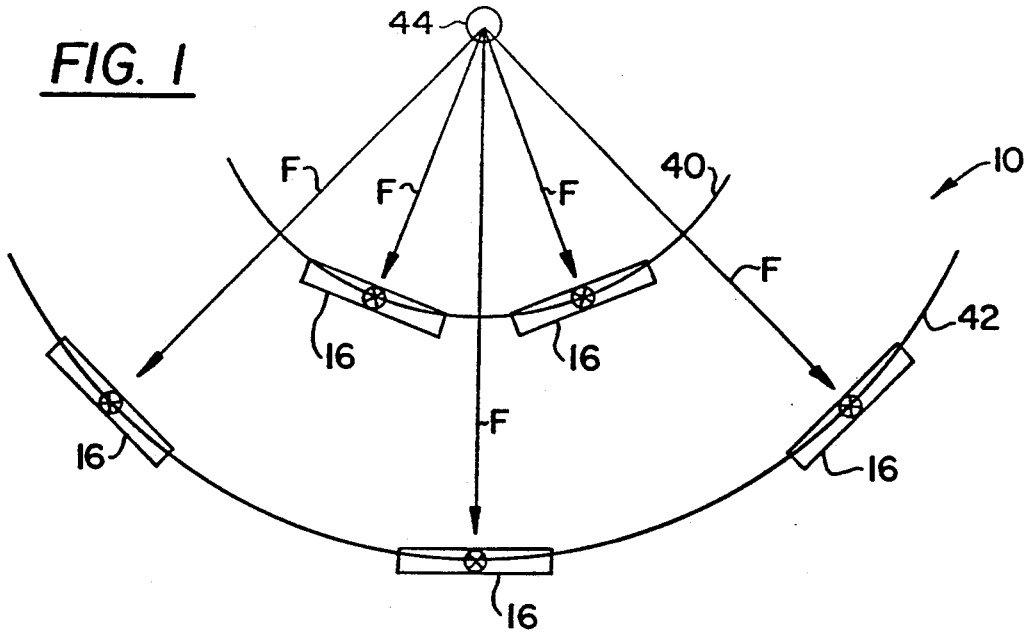
FIG. 1 is a schematic plan view of a lamp shade having two laterally spaced arrays of light deflectors.
Figure 2:
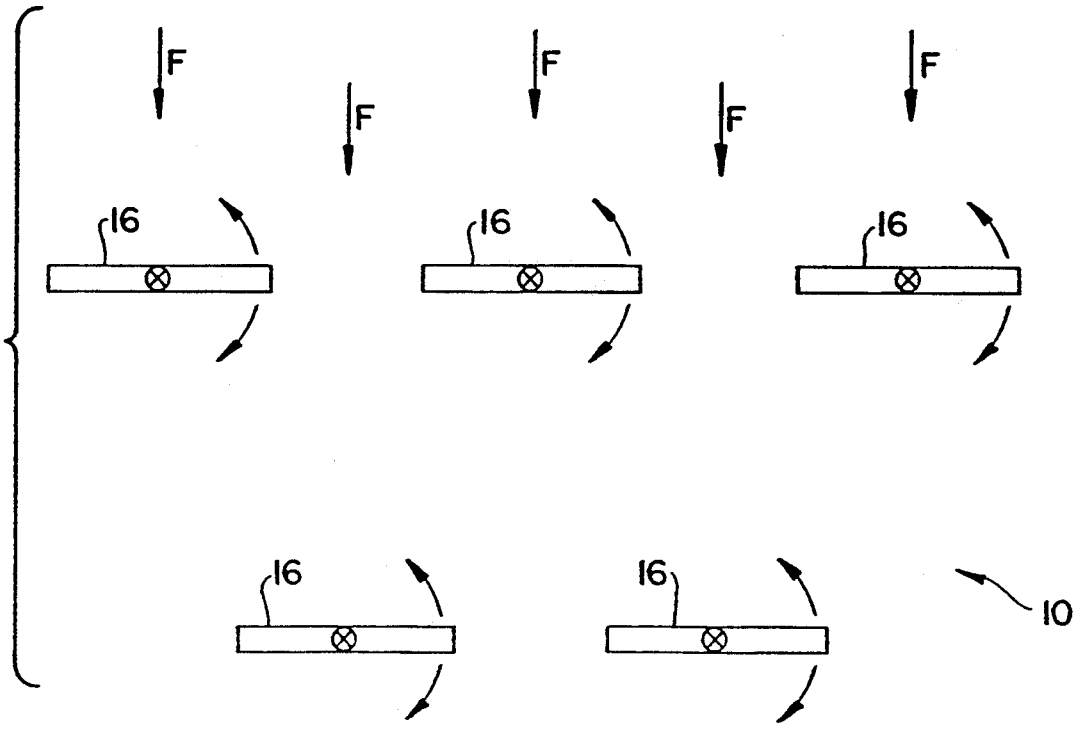
FIG. 2 is a schematic plan view of an alternate arrangement of two laterally spaced arrays of light deflectors.

FIGS. 1 and 2 show a lamp shade or shield 10 with the light deflectors 16 being arranged on two laterally spaced support frames 40 and 42 to define two, laterally spaced light deflector arrays. With the light deflectors 16 arranged as shown in FIGS. 1 and 2, the light emitted from the light source 44, shown by arrows F, will be completely blocked due to the overlap of light deflectors 16 on the first support frame 40 with those on the second support frame 42. The light deflectors 16 are arranged on the support frames so that when they are in a position perpendicular to that of the emitted light, as shown in FIGS. 1 and 2, they will overlap sufficiently to block all of the light emitted from the light source 44.

An advantage of having the light deflectors 16 arranged in two or more laterally spaced support frames 40 and 42, is that it is easier to independently rotate each light deflector 16. Accordingly, the light deflectors 16 can be rotated to permit substantially all of the light through to the area where it is needed and the light deflectors 16 can be rotated to substantially block or redirect the light from the areas where it is not needed. Each light deflector 16 can also be freely rotated independently with respect to any other light deflector because there is no physical interference between adjacent light deflectors 16. Also, a user is less likely to accidentally adjust the position of an adjacent light deflector 16 when adjusting the position of a desired light deflector 16.

Figure 18:
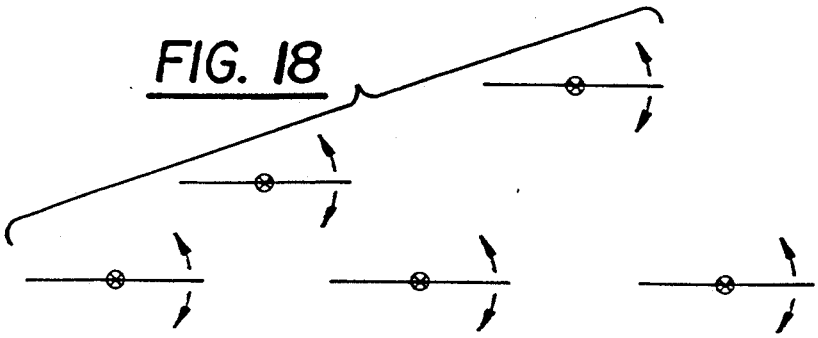
FIG. 18 is a schematic view of two laterally spaced light deflector arrays in accordance with a further alternate embodiment of the invention.

Of course, depending on the user's needs, more than two laterally spaced of light deflector 16 can be provided. Furthermore, as shown in FIG. 18, the light deflectors of each array and/or within each array need not be of the same width and one deflector array of the lamp shade does not have to be parallel to every other deflector array.

The lamp shade 10 of the present invention is most preferably constructed of at least two support frames, each of which may include one, two or more support elements and a plurality of light deflecting elements or members (light deflectors), as discussed above. Each support frame and the plurality of light deflectors mounted thereto form a lamp shade portion which defines a deflector array. Two or more lamp shade portions or deflector arrays, laterally spaced as shown in FIGS. 1 and/or 2 thus define the lamp shade of the most preferred embodiment of the invention.

The light deflectors and how they may be mounted are described herein below. For clarity, only one lamp shade portion is illustrated in each of FIGS. 3–6. However, it is to be understood that, as noted above the invention may advantageously include two or more lamp shade portions.

Figure 3:
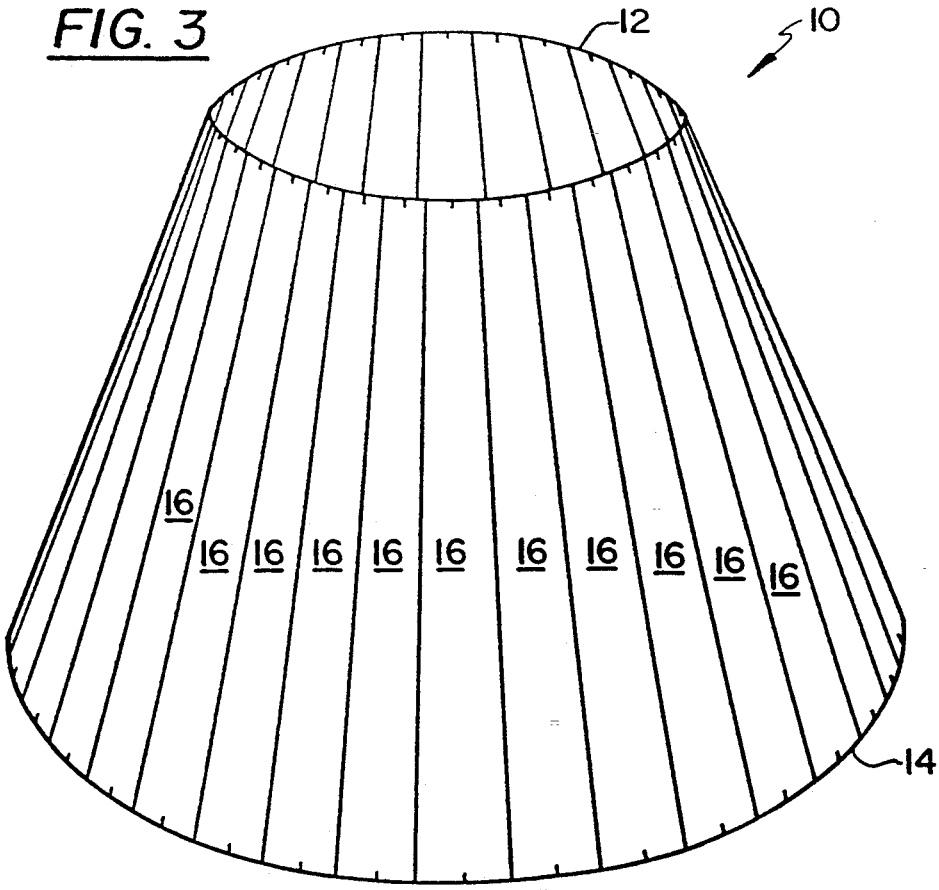
FIG. 3 is a perspective view of light deflectors attached to a support frame to form a light deflector array in accordance with one embodiment of the present invention.

In the embodiment of FIG. 3, the frame comprises two ring shaped, horizontally disposed support members 12, 14 and the light deflectors 16 are coupled at each longitudinal end to one of the support members. The deflectors 16 can be directly coupled to each of the support members 12,14 or the frame can include spoke elements like those shown at 18 which extend between spaced portions of the support and the deflectors 16 can be rotatably mounted to the spokes in any suitable manner. Thus, the interconnection of the deflectors 16 to the support members 12,14 is only schematically shown and illustrative coupling elements are discussed more fully by way of example, below.

In the illustrated embodiment, the lower support member 14 has a greater diameter than the upper support member 12. However, the support members could be of equal diameter or the upper support member 12 can have a greater diameter than the lower support member 14. Also, the frame, whether defined by one or more support members, could be in the form of an arc, a plane or a spiral, depending on the type of lamp, the lighting desired, and stylistic preferences of the user.

Figure 6:
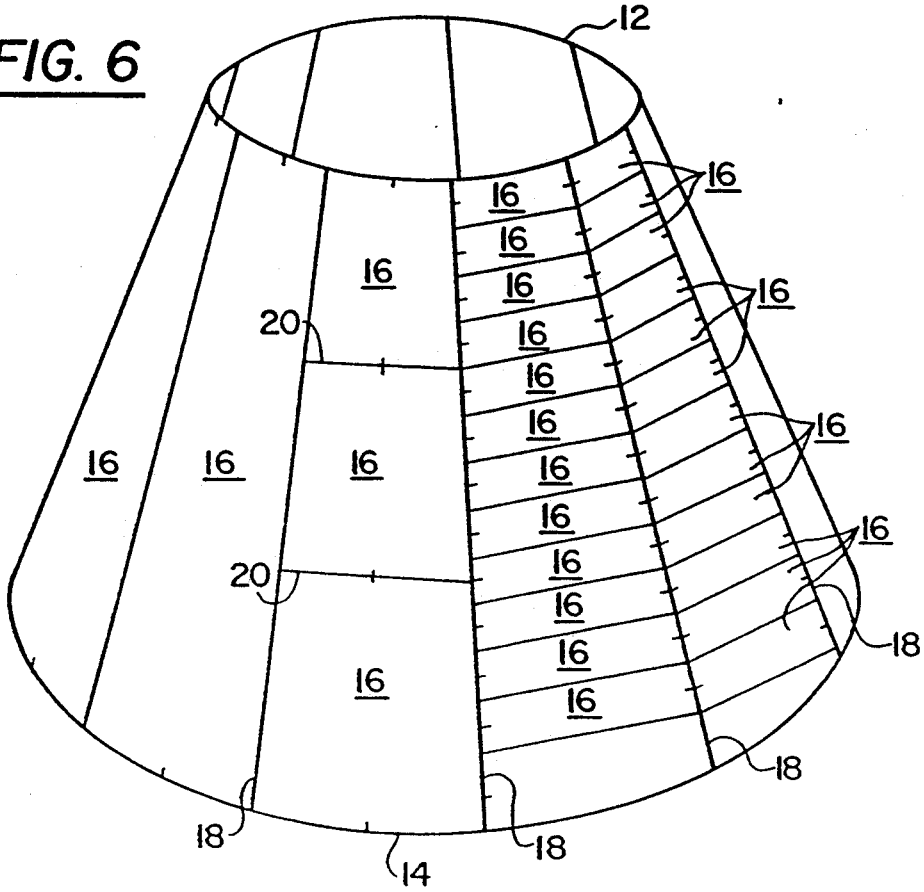
FIG. 6 is a perspective view of a light deflector support frame in accordance with yet another embodiment of the invention which has light deflectors in both horizontal and vertical orientations.

Even further, the deflectors 16 need not all be disposed generally vertically as shown in FIG. 3. Indeed, the deflectors 16 may be disposed horizontally or a combination of horizontal and vertical deflectors 16 could be provided, as shown in FIG. 6, to maximize lighting versatility. When horizontal deflectors 16 are provided, the frame necessarily includes at least some vertical support members or spokes 18. The light deflectors 16 are then rotatably supported between two adjacent spoke elements 18.

Figure 5:
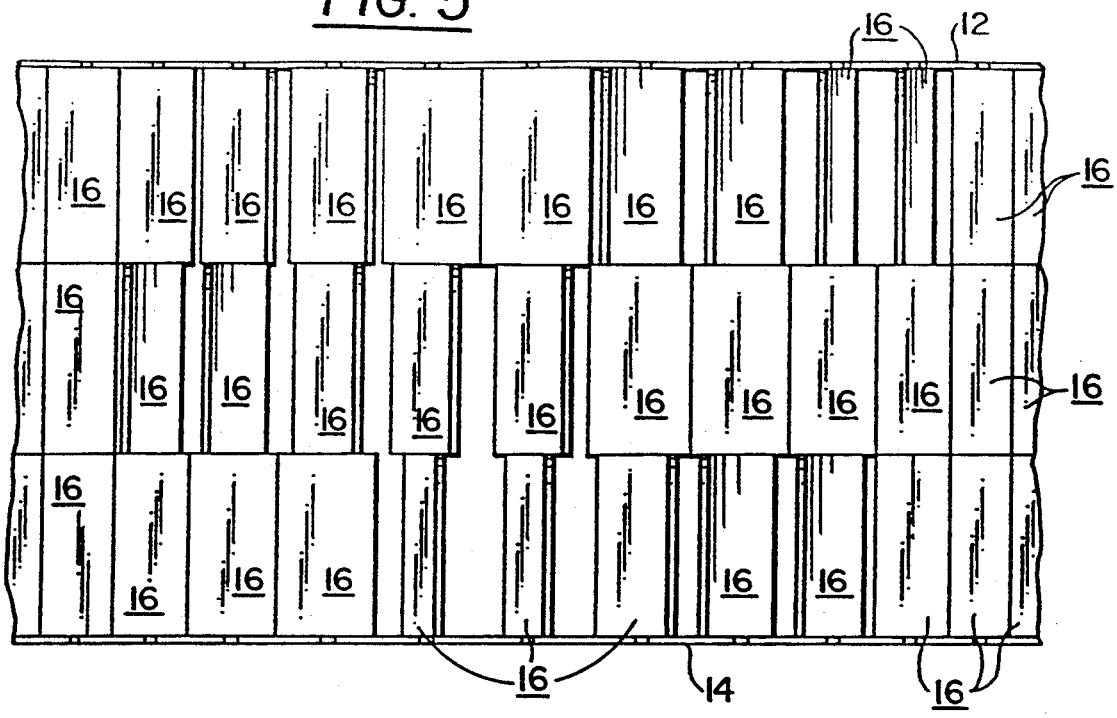
FIG. 5 is an enlarged partial elevational view of a light deflector support frame in accordance with another embodiment of the invention which has several tiers of light deflectors.

As a further alternative, the light deflectors 16 may be disposed, or even interconnected, end to end or edge to edge so that the lamp shade 10 comprises a plurality of vertically adjacent deflectors 16. By way of example, FIG. 5 illustrates three tiers of vertically oriented light deflectors in combination with a plurality of horizontally disposed light deflectors 16. Each of the light deflectors 16 is preferably independently rotatable. Thus, as illustrated, the user can easily independently adjust the light deflectors 16 to various angles to vary the light intensity and direction along the height and width of the lamp shade 10 to accommodate the particular environment which the light fixture is to be used. Such assemblies of interconnected deflectors 16 may extend along a portion of the height and/or width of the shade or may extend all the way between the upper and lower peripheral supports 12,14. As noted above, the frame may include horizontal spokes 20 and/or vertical spokes 18 to which the adjacent deflectors 16 are directly or indirectly coupled, or the deflectors 16 may be simply adjacent or directly coupled to one another. As is apparent from FIG. 6, any combination of sizes and orientations of light deflectors 16 may be used in a single lamp shade 10.

The light deflectors 16 may be mounted to the frame in any manner which allows them to be independently rotatable relative to the frame and each other from a position which allows light to pass without obstruction or deflection to a position which allows no light to freely pass and any point therebetween.

Some exemplary mounting configurations are disclosed herein below, but it is to be understood that the invention is not to b limited to the illustrated and described mounting configurations, nor is it limited to end mounting the deflector elements.

Spoke elements 18 may extend between vertically or horizontally spaced frame or support members 12,14 and the deflectors 16 may be directly coupled thereto so as to be rotatable thereabout to present a face of varying inclination and functional width.

In the alternative, straight pegs and peg receiving sockets can be provided on the deflectors 16 and/or on the support frame 12,14 to allow rotation or pivoting of the deflectors 16 about an axis passing therethrough.

Figure 7:
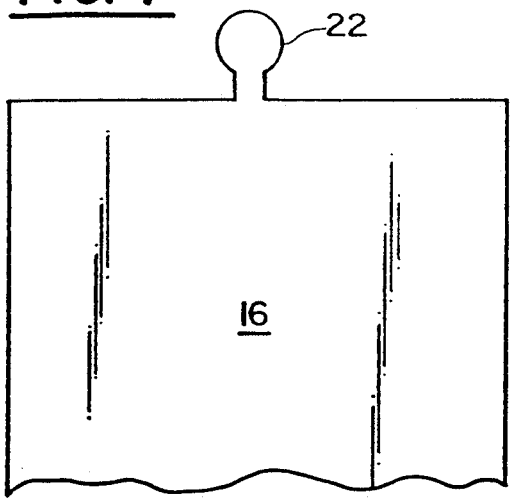
FIG. 7 is a view, partially broken away, of a light deflector having a ball and socket-type connector.

As an alternative, as shown in FIG. 7, a ball and socket connection can be provided for mounting a light deflector 16 to a support member 12,14. In the illustrated embodiment, a ball element 22 is coupled to a peripheral edge of the deflector 16 and is received in a correspondingly sized and shaped socket (not shown) coupled to the support frame of the shade. The connectors may, of course, be reversed so that the socket is coupled to the deflector 16. Further, in the event a plurality of light deflectors 16 are interconnected end to end or edge to edge, the light deflectors 16 may be provided with a ball 22 at one end and a socket at the other end.

A ball and socket connection will allow rotational movement of the deflector 16 if the deflector 16 is coupled to and extends between two support members 12,14 of the frame. That rotational motion is about an axis of rotation extending between those two connections. If the deflector 16 is coupled to the frame at only one end thereof, such a ball and socket connection allows the light deflector 16 to be moved with three degrees of freedom and thus it can be pivoted relative to the frame in addition to rotated about its axis.

Figure 8:
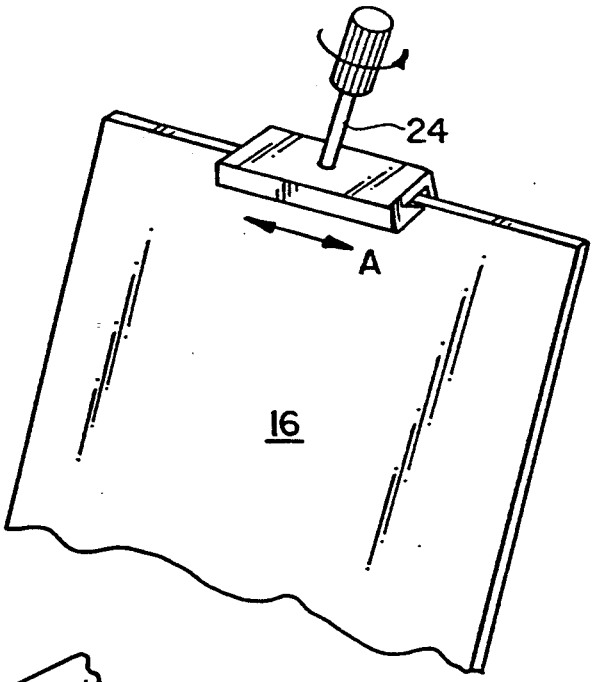
FIG. 8 is a view, partially broken away, of a light deflector having a connector defining two degrees of freedom.

As yet a further alternative, a connector of the type shown in FIG. 8, which allows the light deflector 16 to move with two degrees of freedom, can be provided. The embodiment of FIG. 8 allows the light deflector 16 to pivot or rotate about the axis of the rod 24 and allows the light deflector 16 to be slid in the direction of arrow A. The connector of FIG. 8 can be connected to the frame of the lamp shade in any suitable manner. For example, rod 24 can extend through a bore defined through support member 12 whereby rotation of rod 24 relative to the support member 12 is possible.

Figure 9:
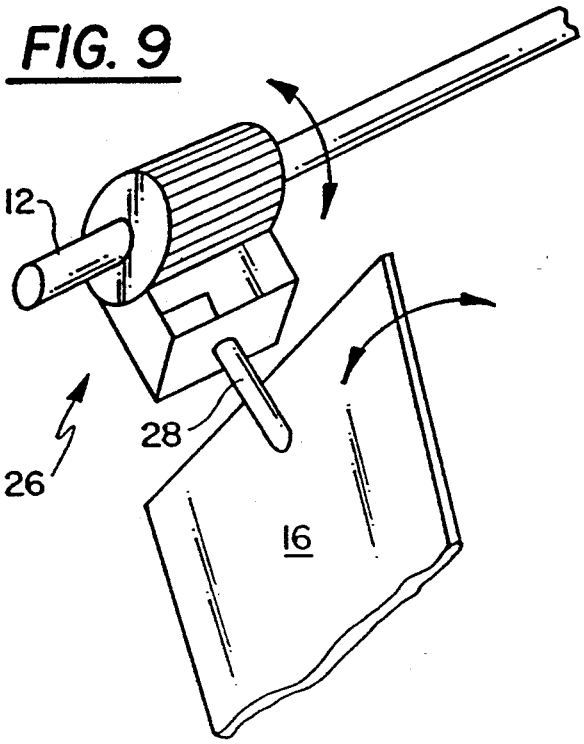
FIG. 9 is a view, partially broken away, of another light deflector having a connector defining two degrees of freedom.

As yet a further alternative a connector 26 of the type illustrated in FIG. 9 can be provided. That connector is similar in many respects to that of FIG. 8 and element 16 may be slidably coupled to the connector 26 in a like manner. The connector 26 of FIG. 9 is characterized in that it is pivotally connected to the support, for example support member 12, and the light defecting element 16 is rotatably coupled thereto. The coupling to the frame can be sufficiently snug that the connector 26 will remain in an orientation in which it has been placed or a set screw can be provided to lock the connector in a selected position. Likewise, the light deflector 16 can be retained in a particular position in any known manner. For example, the rod 28 can be threaded and be threadably engaged with connector 26 to thereby hold a selected rotatory position.

Light deflectors 16 can be made of any of a number of different materials or combination of materials depending on the type of lamp with which it is used, the area to be lit, and the type and style of lighting desired. Thus, the light deflectors 16 can be made, for example of plastic, a rigidified or framed fabric or other natural or man-made material, metal and/or glass. The materials chosen for the light deflector 16 can also vary in transparency, reflectivity, and color. Thus, the light deflectors can be made of a material that is light reflective, such as metal, whether or not colored, or a mirrored material. Alternatively, the light deflectors can be made of a translucent material to thereby allow only some light to pass therethrough while reflecting the rest. As yet a further alternative, the light deflectors can have two different surfaces such as a mirror or metalized surface on one side and a non-reflective material or fabric on the other side.

FIGS. 10–17 illustrate a variety of alternative configurations for the light deflectors, but are merely exemplary and not exhaustive.

Figure 10:
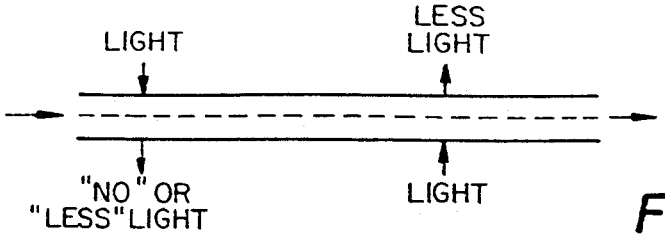
FIGS. 10–17 are schematic perspective views of exemplary light deflector configurations in accordance with the invention.
Figure 11:
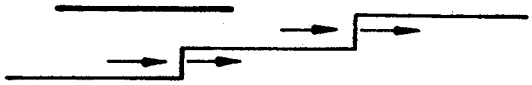
Figure 12:
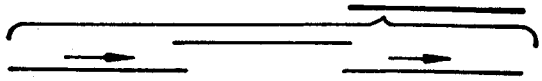
Figure 13:
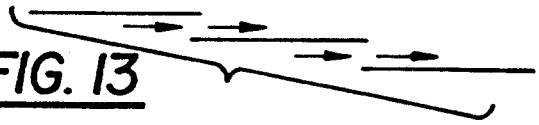

Indeed, the light deflectors, although in general elongated, can have many shapes and can be made in a variety of different ways. One characteristic that the deflectors preferably have in common is that more light will pass the deflector when it is rotated so that its major dimension is not perpendicular to incident light (FIG. 10). Each deflector may be defined by a series of step-like elements, made in one piece by, for example, extruding a translucent polymer as a stepped plate and then applying a metal sheet to, or otherwise coating selected portions of the light deflector so that other portions remain transparent or translucent (FIG. 11). As yet a further alternative, each light deflector can itself be formed from a plurality of sheets jointed together in any suitable manner to form a staggered or stepped deflector (FIGS. 12 and 13).

Figure 14:
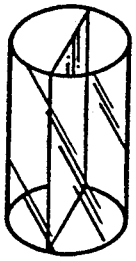

Yet a further alternative is to provide a hollow body, such as a cylinder, having a metal or other opaque sheet inside as a deflector. The light deflector could be made, instead, inside a solid body, such as an acrylic or polyester body (FIG. 14).

Figure 15:
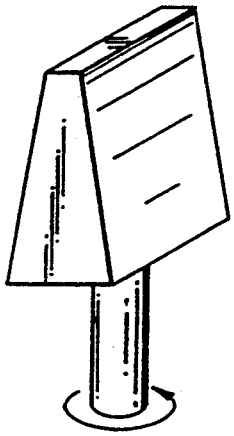

Rather than using a sheet-like material to form the light deflectors, the light deflector may be blow molded to form a structure where one or more surfaces are light deflecting or would could an light deflector inside or applied to the surface thereof (FIG. 15).

Figure 16:
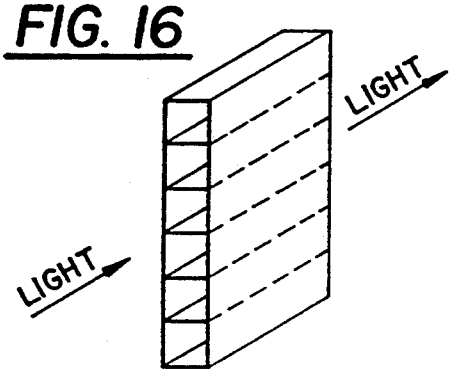
Figure 17:
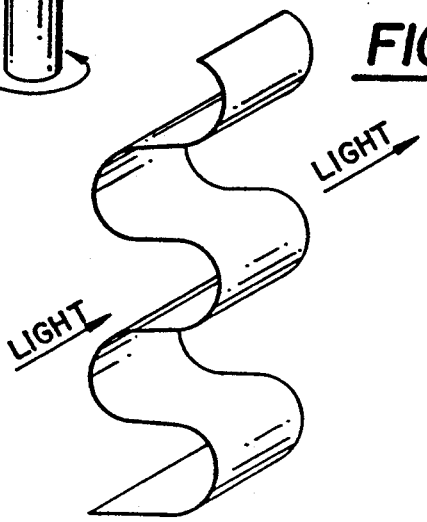

The light deflectors could also be made by joining several thin "sheets" together, to form a structurally strong, three dimensional element (FIG. 16). Alternatively by bending or otherwise shaping a single sheet of material, a three dimensional light deflector can be provided (FIG. 17). As is apparent, the light deflectors do not have to be planar, and the surface can be made in such a way to have directional deflection (focusing) properties. Also, the deflectors do not have to be rigid. Even further, irrespective of the shape or composition of the light deflectors, the light deflectors do not have to be mounted at their end(s) for movement relative to the frame and need not be mounted for rotation about an axis thereof. Any or all could be mounted to rotate about an axis which passes therethrough to intersect it at a point, or does not intersect the deflector itself at all.

As is apparent, the variety of materials for and shapes of the light deflectors and the various combinations thereof are limited only by the manufacturer's imagination.

Figure 4:
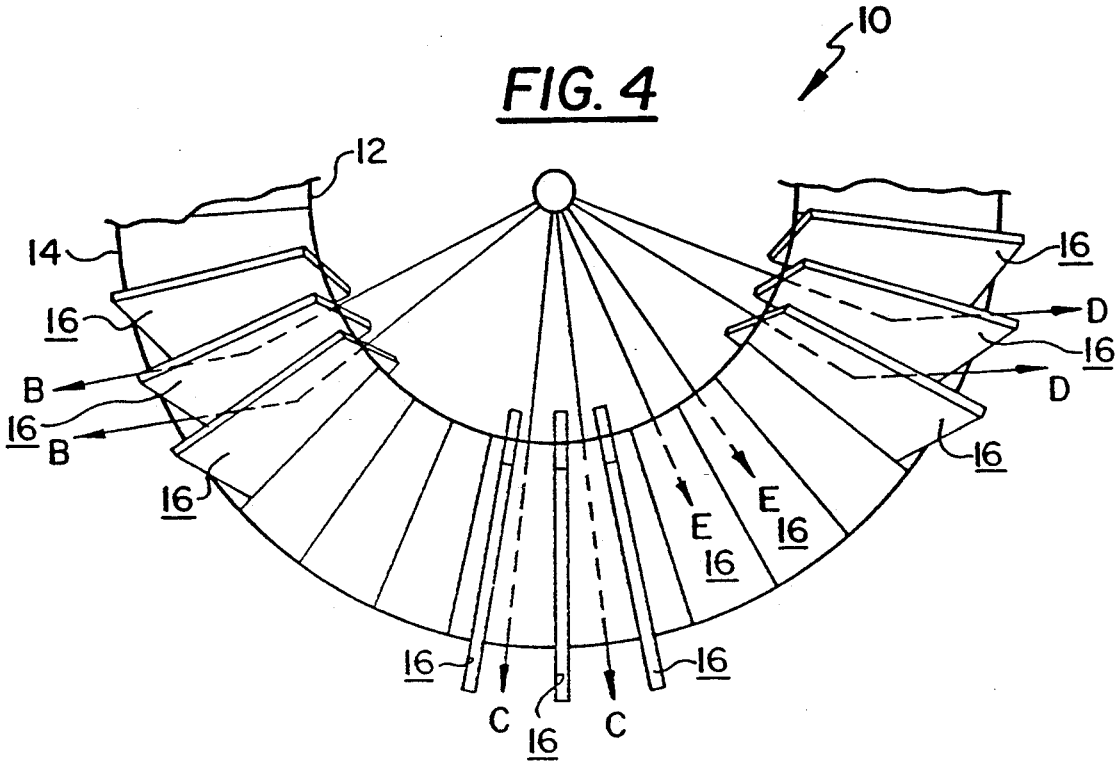
FIG. 4 is a top plan view of the lamp shade of FIG. 1 with the light deflectors in various angled positions to control the distribution of light.

FIG. 4 shows the lamp shade 10 with the light deflectors 16 rotated in various directions. As shown, depending on the angle of the light deflector 16, the light emitting from the light source can be allowed to pass straight through the lamp shade 10 (arrow C), to be deflected to pass in a particular direction (arrows B and D), or to be partially or wholly obstructed (arrow E).

While the invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A lamp shade comprising:

a) a first lamp shade portion including:

a first support frame;

a plurality of light deflecting elements, each of said light deflecting elements having a first end and a second end spaced from said first end; and first mounting means for mounting at least one of said light deflecting elements to said first support frame so that said at least one of the light deflecting elements can be moved, independently, relative to said first support frame and other light deflecting elements;

b) a second lamp shade portion including:

a second support frame;

a plurality of light deflecting members, each of said light deflecting members having a first end and a second end spaced from said second end; and second mounting means for mounting at least one of said light deflecting members to said second support frame so that said at least one of the light deflecting members can be moved, independently, relative to said second support frame and other light deflecting members; and c) said first lamp shade portion and said second lamp shade portion are interconnected but laterally spaced so that the light deflecting elements define a first array of light deflectors and the light deflecting members define a second array of light deflectors, and a lateral gap is defined between said first and second arrays of light deflectors

2. A lamp shade as recited in claim 1, wherein each of said first and second support frames comprises a ring member, at least some of said light deflecting elements and at least some of said light deflecting members being mounted to a respective said ring member.

3. A lamp shade as recited in claim 1, wherein at least some of said light deflecting elements depend downwardly from said first support frame and at least some of said light deflecting members depend downwardly from said second support frame.

4. A lamp shade as recited in claim 1, wherein at least a portion of at least some of said light deflecting elements are light reflective.

5. A lamp shade as recited in claim 1, wherein at least a portion of at least some of said light deflecting elements are translucent.

6. A lamp shade as recited in claim 1, wherein each of said first and second support frames comprises an upper support element and a lower support element, at least some of said light deflecting elements being mounted at said first end thereof to said upper support element and at said second end thereof to said lower support element.

7. A lamp shade as recited in claim 6, wherein said upper support element is an upper ring member and said lower support element is a lower ring member.

8. A lamp shade as recited in claim 7, wherein said lower ring member has a diameter greater than said upper ring member.

9. A lamp shade as recited in claim 1, wherein at least some of said light deflecting elements are mounted so as to be aligned end to end, to define light deflecting assemblies.

10. A lamp shade as recited in claim 9, wherein at least some of said light deflecting assemblies are disposed at an angle of greater than zero with respect to a horizontal plane.

11. A lamp shade as recited in claim 9, wherein each of said light deflecting elements in said light deflecting assemblies are independently rotatable.

12. A lamp shade as recited in claim 9, wherein at least some of said light deflecting elements are mounted horizontally 13. A lamp shade as recited in claim 1, wherein at least one of said first and second support frames comprises a plurality of vertically spaced apart, interconnected support tiers, a plurality of light deflecting elements being rotatably mounted to each said support tier.

14. A lamp shade as recited in claim 1, wherein at least some of said light deflecting elements are pivotable relative to said support frame.

15. A lamp shade as recited in claim 1 wherein said first mounting means allows the light deflecting elements to be moved with at least two degrees of freedom.

16. A lamp shade as recited in claim 1 wherein said first mounting means allows the light deflecting elements to be moved with three degrees of freedom.

17. A lamp shade as recited in claim 16, wherein said first mounting means comprises a ball and socket connection.

18. A lamp shade as recited in claim 1 wherein said first mounting means comprises a pin and socket therefor.

19. A lamp shade as in claim 1, wherein at least some of said light deflecting elements are mounted horizontally and at least some of said light deflecting elements are mounted vertically.

20. A lamp shade as in claim 1, wherein said light deflecting elements each have substantially the same width, said light deflecting members each have substantially the same width, and the light deflecting elements each have substantially the same width as said light deflecting members.

21. A lamp shade as recited in claim 1, wherein said first support frame comprises a plurality of vertically spaced apart, interconnected support tiers, a plurality of light deflecting elements being mounted to each said support tier.

22. A lamp shade comprising:

(a) a support frame;

(b) a plurality of light deflecting elements, each said light deflecting element having a first end, a second end spaced from said first end and an axis; and (c) mounting means for mounting said light deflecting elements to said support frame so that at least some of said light deflecting elements are movable, independently, relative to the support frame and other light deflecting elements, at least some of said light deflecting elements being generally aligned end to end, with a second end of one light deflecting element adjacent to a first end of a next adjacent light deflecting element, to define light deflecting assemblies, the axes of the light deflecting elements in each said light deflecting assembly being defined in a common plane, said common plane being disposed at an angle of greater than zero with respect to a horizontal plane of said support frame.

* * * * *